US006220193B1

(12) United States Patent
Dilks

(10) Patent No.: US 6,220,193 B1
(45) Date of Patent: Apr. 24, 2001

(54) SURFACE EFFECT BOAT WITH JET PROPULSION ENGINES HOUSE IN KEEL FORMED CAVITIES

(76) Inventor: Leslie Dilks, 23 St. James's Chambers, St. James's Street, Derby, DE1 1QZ (GB)

( * ) Notice: Subject to any disclaimer, the term of this patent is extended or adjusted under 35 U.S.C. 154(b) by 0 days.

(21) Appl. No.: 09/468,129

(22) Filed: Dec. 21, 1999

(51) Int. Cl.[7] ..... B63B 1/34
(52) U.S. Cl. ..... 114/67 A; 440/45
(58) Field of Search ..... 114/67 A; 440/45

(56) References Cited

U.S. PATENT DOCUMENTS

| | | | | |
|---|---|---|---|---|
| 3,405,675 | * | 10/1968 | Cockerell et al. | 114/67 A |
| 3,538,878 | * | 11/1970 | Zalman | 114/68 |
| 3,742,888 | | 7/1973 | Crowley . | |
| 4,227,475 | * | 10/1980 | Mattox | 114/67 A |
| 4,228,752 | * | 10/1980 | Sladek et al. | 114/67 A |
| 4,393,802 | | 7/1983 | Rizzo . | |
| 4,836,121 | * | 6/1989 | Kordon | 114/67 A |
| 5,570,650 | * | 11/1996 | Harley | 114/61 |
| 5,746,146 | * | 5/1998 | Bixel, Jr. | 114/67 A |

FOREIGN PATENT DOCUMENTS

| | | | | |
|---|---|---|---|---|
| 1190621 | | 5/1970 | (GB) . | |
| 1210973 | * | 11/1970 | (GB) | 114/67 A |
| 1545900 | * | 5/1979 | (GB) | 114/67 A |
| 2 285 415 | | 7/1995 | (GB) . | |
| 2 299 974 | | 10/1996 | (GB) . | |
| WO 98/175242 | | 4/1998 | (WO) . | |

* cited by examiner

*Primary Examiner*—S. Joseph Morano
*Assistant Examiner*—Andrew Wright
(74) *Attorney, Agent, or Firm*—Larson & Taylor, PLC

(57) ABSTRACT

A boat includes a plurality of longitudinal keels below the deck. The space between the keels is closed, at both ends, to form an enclosed downwardly open cavity. Jet propulsion engines are provided at the forward end of each cavity, well above the waterline, to pressurize the cavities with exhaust gases. A cavity enclosing stern plate includes an open tube, fitted with a variable control valve, passing therethrough, well above the waterline. The stern plate, and a cavity enclosing bow plate are set at a forwardly leaning angle, and a flexible trailing seal is fixedly attached to the bottom faces of the plates.

3 Claims, 2 Drawing Sheets

SURFACE EFFECT BOAT WITH JET PROPULSION ENGINES HOUSE IN KEEL FORMED CAVITIES

BACKGROUND OF THE INVENTION

1. Field of the Invention

This invention relates to boats and in particular the reduction of resistance to forward motion of high speed water borne vessels.

2. Description of the Related Art

In the past numerous attempts have been made to improve the efficiency of water borne vessels by reducing the resistance to forward motion but very few have been really successful. The notable exceptions being hovercraft and hydrofoils but even these are very specialised and have not fulfilled their original conceptual potential.

SUMMARY OF THE INVENTION

By taking advantage of modern technology it is the objective of the present invention to improve the efficiency of large ocean going vessels and high speed river transport.

The major objective of the present invention is to provide a boat powered by the thrust of a pure jet engine or engines of the type used in high speed aircraft.

According to the present invention a surface effect boat which, in operation, rides on a cushion of contained pressurized gases, said boat having a water line, a bow and stern and comprising a hull and a deck extending horizontally and longitudinally above the hull, said hull including at least three longitudinally extending keels extending the full length of the boat and defining spaces between the keels, a bow plate closing one end of the spaces and a stern plate closing the opposite end of the spaces so as to define at least two downwardly opening cavities, and a single power source comprising at least two gas turbine jet propulsion engines, each of said engines being mounted on the boat, at the bow thereof, within a corresponding cavity between the keels, and being fixedly attached to an underside portion of the deck substantially above the water line of the boat, said engines producing high volume exhaust gases which pressurize the respective cavities with a pressure such that, as the boat is caused to gather speed in response to thrust forces produced by said engines, said pressure increases sufficiently to lift the boat in the water and to thereby substantially reduce resistance to forward motion, a gas pressure discharge tube being disposed in each of said cavities and being fixedly attached to and extending through said stern plate, a control valve being associated with each of said tubes for regulating said pressure, and said keels including inner side plates terminating and downwardly depending knife edge seals.

The bow and stern plates are set at an acute forward leaning angle, the bow plate to reduce air resistance and the stern plate to deflect jet exhaust gases downwards and outwards under the stern plate. Both the bow and stern plates have fixedly attached to their bottom faces flexible trailing seals.

BRIEF DESCRIPTION OF THE DRAWINGS

To the accomplishment of the above and related objects this invention may be embodied in the forms illustrated in the accompanying drawings. Attention is drawn to the fact however that the drawings are illustrative only and that changes may be made in the specific constructions illustrated and described so long as the scope of the appended claims is not violated. Specific embodiment of the invention will now be described by way of example with reference to the accompanying drawings in which:

DESCRIPTION OF THE PREFERRED EMBODIMENTS

Figure 1:
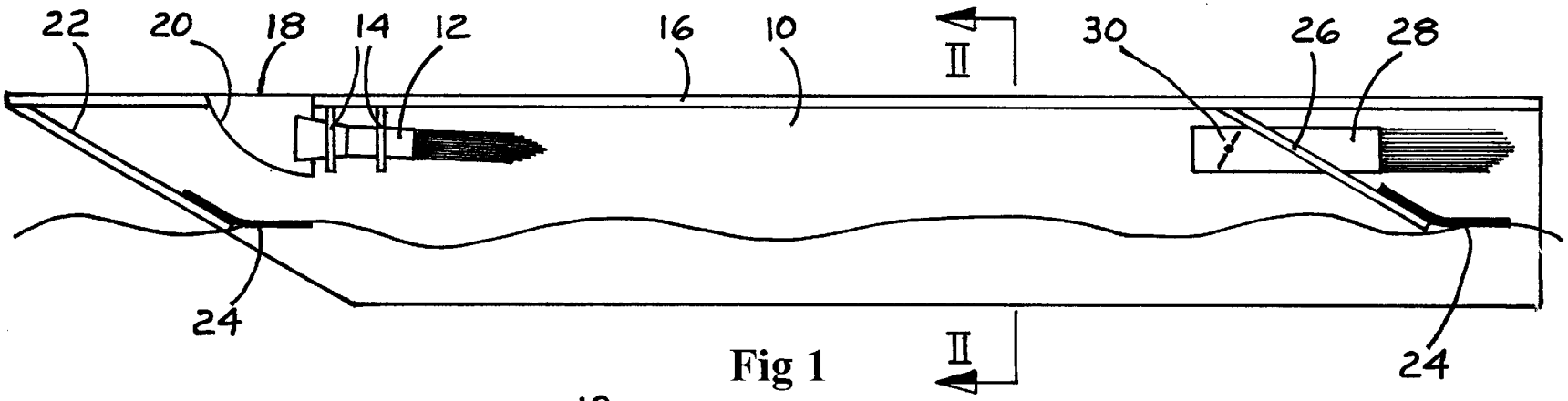
FIG. 1 shows a sectional side view of the embodiment.

Referring to FIG. 1 there is shown a boat (10) with jet engine (12) mounted on supports (14) which are fixedly attached to the underside of the deck (16).

The jet engine (12) is shown mounted at a slight angle to give added lift to the bow.

The jet engine (12) draws air through a hole (18) in the deck (16) and through ducting (20) which is fixedly attached to the underside of the deck (16).

A bow plate (22) and a stern plate (26) are shown fixedly attached to the underside of the deck (16). Flexible trailing seals (24) are also shown fixedly attached to the bottom faces of both the bow plate (22) and the stern plate (26).

Passing through and fixedly attached to the stern plate (26) is a tube (28) in the bore of which is fixedly attached a variable control valve (30).

Figure 2:
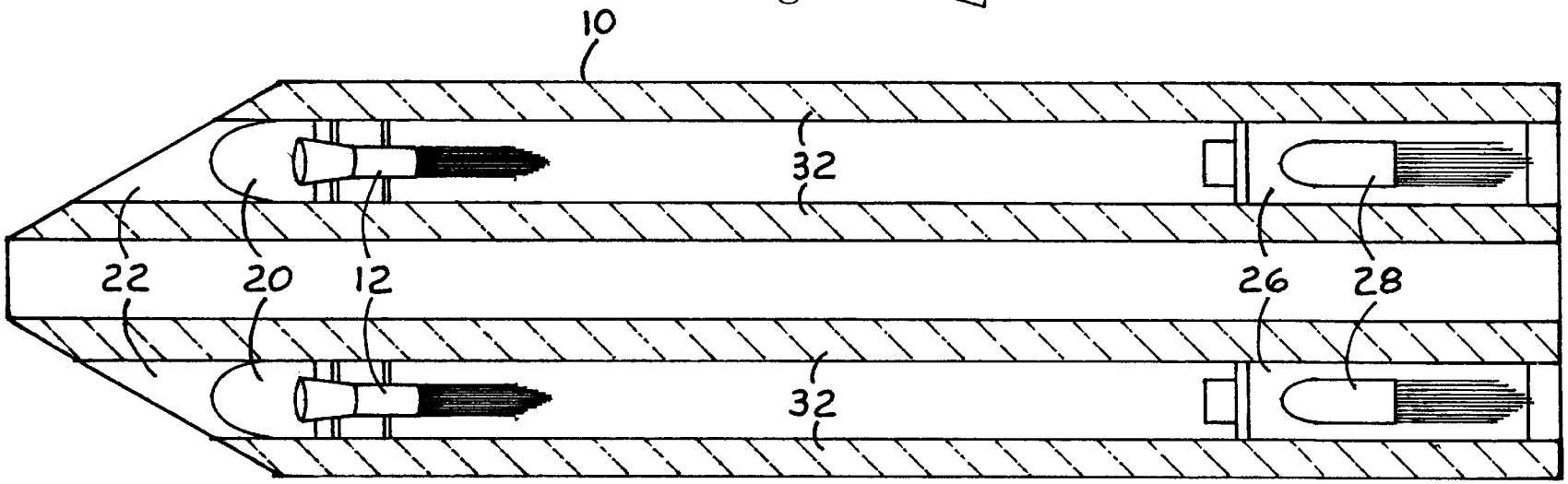
FIG. 2 shows a sectional plan view of the embodiment with two engines and four keels.

Referring now to FIG. 2 this shows a sectional plan view below the deck (16) of a boat (10) with two engines (12) and four keels (32). The two engines (12) are shown mounted centrally between the keels (32) at the bow of boat (10) and the exhaust tubes (28) are shown mounted centrally between the keels (32) at the stern.

The bow plates (22) are clearly shown sealing the space between the keels (32).

At eh rear of boats (10) the stern plates (26) are shown sealing the space between the keels (32) with the exhaust tubes (28) passing through.

Figure 3:
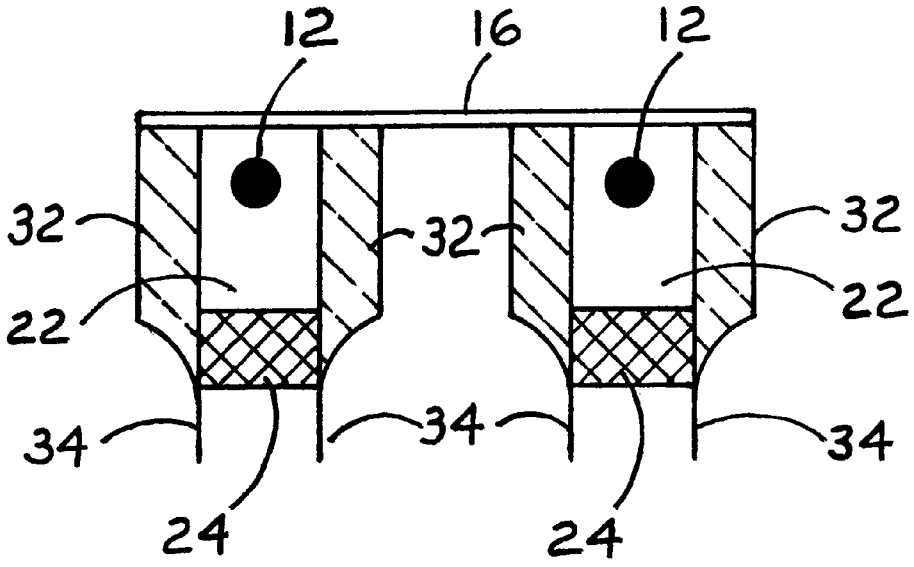
FIG. 3 shows a sectional end view along the lines II—II in FIG. 1.

FIG. 3 shows a sectional end view looking towards the bow with the jet engines (12) shown mounted centrally between the keels (32) and below the decks (16). The bow plates (22) are shown fixedly attached to the underside of decks (16) and to the keels (32) with the flexible trailing seals (24) shown fixedly attached to the bottom edge of the said bow plates (22).

The inner faces of the keels (32) are shown extended downwards to form knife edge seals (34) which reduce resistance to forward motion when travelling at high speed.

What is claimed is:

1. A surface effect boat which, in operation, rides on a cushion of contained pressurized gases, said boat having a water line, a bow and stern and comprising a hull and a deck extending horizontally and longitudinally above the hull, said hull including at least three longitudinally extending keels extending the full length of the boat and defining spaces between the keels, a bow plate closing one end of the spaces and a stern plate closing the opposite end of the spaces so as to define at least two downwardly opening cavities, and a single power source comprising at least two gas turbine jet propulsion engines, each of said engines being mounted on the boat, at the bow thereof, within a corresponding cavity between the keels, and being fixedly attached to an underside portion of the deck substantially above the water line of the boat, said engines producing high volume exhaust gases which pressurize the respective cavities with a pressure such that, as the boat is caused to gather speed in response to thrust forces produced by said engines, said pressure increases sufficiently to lift the boat in the water and to thereby substantially reduce resistance to forward motion, a gas pressure discharge tube being disposed in each of said cavities and being fixedly attached to and extending through said stern plate, a control valve being associated with each of said tubes for regulating said pressure, and said keels including inner side plates terminating and downwardly depending knife edge seals.

2. A boat as claimed in claim 1 wherein the bow plate and the stern plate are set at an acute, forwardly leaning angle.

3. A boat as claimed in claim 1 further comprising flexible trailing seals fixedly attached to bottom faces of the bow plate and the stern plate.

* * * * *